US006327832B1

(12) United States Patent
Ernst et al.

(10) Patent No.: US 6,327,832 B1
(45) Date of Patent: Dec. 11, 2001

(54) SHEARING REINFORCEMENT FOR FLAT CEILINGS AND DOWEL STRIP

(75) Inventors: Peter Ernst, Hattersheim; Gerhard Schrader, Frankfurt am Main, both of (DE)

(73) Assignee: DEHA Ankersysteme GmbH & Co. KG, Grass-Gerau (DE)

( * ) Notice: Subject to any disclaimer, the term of this patent is extended or adjusted under 35 U.S.C. 154(b) by 0 days.

(21) Appl. No.: 09/581,754

(22) PCT Filed: Dec. 10, 1998

(86) PCT No.: PCT/EP98/08031

§ 371 Date: Aug. 11, 2000

§ 102(e) Date: Aug. 11, 2000

(87) PCT Pub. No.: WO99/32737

PCT Pub. Date: Jul. 1, 1999

(30) Foreign Application Priority Data

Dec. 18, 1997 (DE) ..... 197 56 358

(51) Int. Cl.[7] ..... E04C 5/16

(52) U.S. Cl. ..... 52/719; 52/719; 52/251; 52/260; 52/414; 52/334; 52/742.1

(58) Field of Search ..... 52/719, 251, 260, 52/334, 414, 742.1

(56) References Cited

U.S. PATENT DOCUMENTS

| | | | | |
|---|---|---|---|---|
| 4,612,747 | * | 9/1986 | Andra et al. | 52/250 |
| 5,655,349 | * | 8/1997 | Ghali et al. | 52/724.1 |
| 5,992,123 | * | 11/1999 | Kies | 52/719 |
| 6,052,962 | * | 4/2000 | Ghali et al. | 52/724.1 |

FOREIGN PATENT DOCUMENTS

| | | |
|---|---|---|
| 27 27 159 | 12/1978 | (DE) . |
| 195 48 685 | 1/1997 | (DE) . |
| 296 14 209 | 1/1998 | (DE) . |

* cited by examiner

*Primary Examiner*—Beth A. Stephan
*Assistant Examiner*—Dennis L. Dorsey
(74) *Attorney, Agent, or Firm*—Burns, Doane, Swecker & Mathis, L.L.P.

(57) ABSTRACT

A flat ceiling includes a reinforcement for resisting shear forces. The reinforcement is arranged in a bearing area for the flat ceiling and includes several dowel strips arranged in a substantially radial position with respect to a ceiling support. The reinforcement includes a dowel rail and several vertical, parallel dowels that are spaced from one another along the rail. Each dowel has a shank and an enlarged head disposed on at least an end of the shank located opposite to the rail. The shanks located adjacent to the support having a larger diameter than the shanks located farther from the support.

10 Claims, 4 Drawing Sheets

Fig. 2
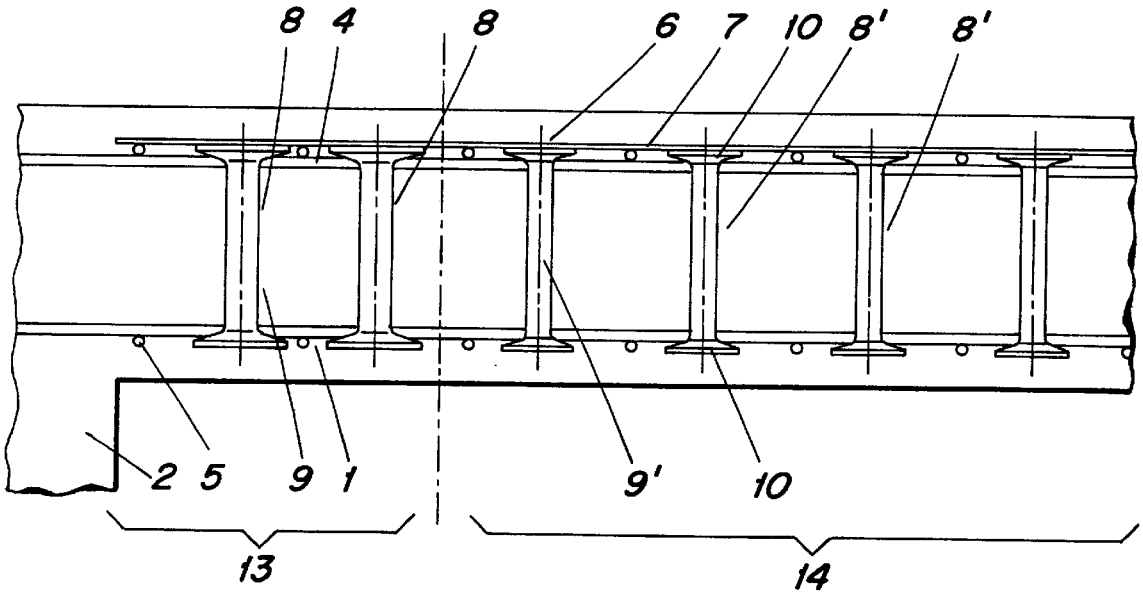
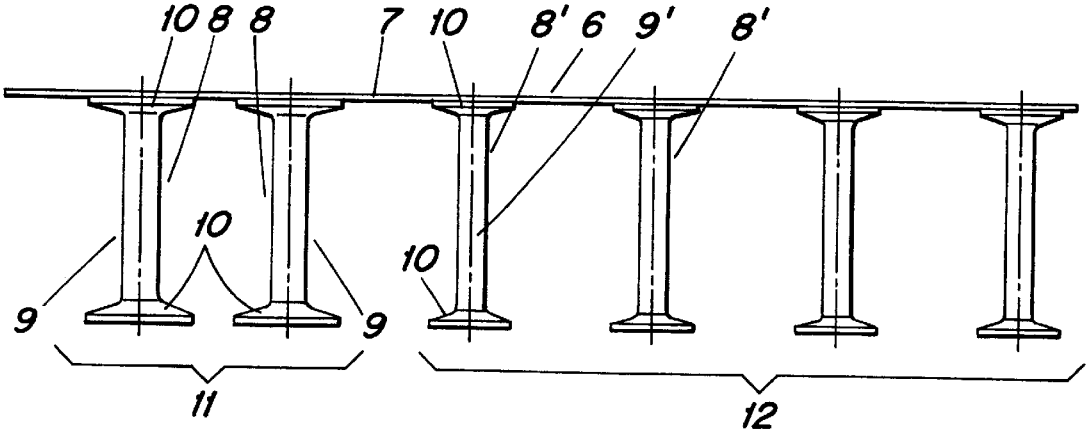
Fig. 3

SHEARING REINFORCEMENT FOR FLAT CEILINGS AND DOWEL STRIP

BACKGROUND OF THE INVENTION

The invention relates to a shearing reinforcement for flat ceilings comprising several dowel strips arranged in a substantially radial position in the bearing area and each consisting of a dowel rail and a plurality of vertical, parallel dowels attached thereto at a distance from one another, whereby said dowels are provided with an elongated dowel shank and an enlarged dowel head on at least one end opposite said rail. The invention relates also to a dowel strip for such a shearing reinforcement.

Shearing reinforcements of this type are used in the transmission of vertical forces occurring in the bearing area of flat ceilings made of reinforced concrete or similar stressed concrete slabs (DE 27 27159 C3). The dowels, which are arranged perpendicular to the plane of the slab, absorb shearing forces that occur in the bearing area. The dowel shanks are thereby substantially stressed by a tensile load.

In addition to the especially favorable arrangement, as seen from a technical manufacturing viewpoint, of placing the dowels at equal distances apart along a dowel strip, it is also known to arrange the dowels at various distances from one another on the dowel strip. In particular, a closely spaced dowel configuration may be chosen for the highly stressed region in the immediate vicinity of the ceiling support of stay. A dowel spacing may be selected that is further apart in the zone away from the stay where there is less stress; however, exceeding the upper deviation value of a given dowel spacing is not permitted since an uneven shearing force distribution could possibly result thereby.

In practice, this leads to the fact that this shearing reinforcement is dimensioned according to stress conditions in the immediate vicinity of the stay and it is over-dimensioned at the region further away from the stay.

It is therefore the object of the invention to provide a shearing reinforcement of the type mentioned at the beginning so that an improved adaptation to the respective occurring stress is obtained.

SUMMARY OF THE INVENTION

This object is achieved according to the invention in that the shank diameter of the dowels near the ceiling support is greater than the shank diameter of dowels disposed further away.

This shearing reinforcement configuration fulfills static requirements to absorb the same vertical load in the region near the stay as in the outer and clearly larger region without experiencing over-sizing of the shearing reinforcement in the outer region and whereby the widest allowable spacing of the dowels, determined especially from static values, is not exceeded.

The selection of a smaller shank diameter for dowels further away from the stay makes possible a more even stress on the dowels corresponding to the actual load distribution. More dowels with smaller shank diameters are better in their load bearing performance than fewer dowels with larger shaft diameters.

Since the dowels have at least on one end, but preferably on both ends, an upsetted (flattened) dowel head (formed while the metal was hot) and said dowel head is about three times larger than the shaft diameter, the amount of energy necessary for manufacturing the dowel head by upsetting shanks with smaller diameters is considerably lower. Production is thereby faster and ecologically better.

Consumption of material and the weight of the dowel strip is reduced by the use of dowels with smaller shank diameters in a substantial part along the length of the dowel strip; this simplifies and makes easier the transportation and assembly at the building site. Since the dowel strips are installed together with an upper and lower ceiling reinforcement that is normally very close on one another, a large dowel head diameter is a hindrance during installation since the space between the two neighboring reinforcement rods is often times very small. A smaller dowel head diameter is therefore better for installation. Furthermore, the insertion of the reinforcement is made easier with smaller shank diameters.

According to a preferred embodiment of the invention it is proposed that in the zone near the stay, dowels are arranged with a diameter that is greater than the diameter of the remaining dowels disposed at the zone away from the stay. The stay reinforcement corresponds thereby to the given static load conditions whereby in the zone near the stay, for example, the same load has to be carried as in the larger zone away from the stay.

The zone near the stay and the zone away from the stay are preferably adjacent to one another whereby each zone is arranged substantially annular and concentric around the stay and whereby the diameter of the zone away from the stay is preferably at least twice as large as the diameter of the zone near the stay.

In addition to the configuration within the scope of the embodiment of the invention wherein the dowels have continuously decreasing diameters from the stay toward the outside, which admittedly makes possible a wide adaptation to the load conditions, but which would require substantial production expenditures, it has been shown to be very beneficial—under consideration of the technical manufacturing conditions—to divide the area around the stay into two zones, namely a highly stressed zone near the stay and a lower stressed zone further away from the stay and to select various shank diameters for the dowels in these two zones. Since so far only two different shank diameters have been proposed, the manufacturing requirements are only slightly higher relative to a version with equal shank diameters; however, at the same time a very favorable adaptation to occurring load conditions is achieved.

According to another preferred embodiment of the invention it is proposed that in the zones near and away from the stay there are disposed separate inner or outer dowel strips. Preferably there is arranged for each inner dowel strip in the zone near the stay an outer dowel strip in the zone away from the stay, both being aligned with one another. This separation into a respective inner and outer dowel strip makes possible to manufacture these two types of dowel strips separately and to separate them from the longer dowel strips, which are equipped with equally designed dowels. In particular, various configurations may be selected for the inner and outer dowel strips, which are not only different in regard to the shank diameter but also in regard to the function of the dowel strip itself carrying the dowels.

Preferably it is proposed that the dowels of the inner dowel strip are welded at one end of their shank to an inner dowel strip and are provided with a dowel head on the other end. The dowels of the outer dowel strip are designed as double-headed dowels, which are attached to an outer dowel strip.

The more costly welding of the dowel to the dowel strip during manufacturing is thereby only used for the inner dowel strip because it is more advantageous for static reasons and which is often times even necessary to pull the dowel strip against the surrounding concrete material for transmission of forces. In the zone way from the stay, where the increased static requirement does not exist, dowel strips are used to only to secure positioning of the dowels so that a more simple type of connection may be selected in view of manufacturing technology. Costly and environment-impacting welding processes may be avoided thereby. These outer dowel strips may be manufactured by having less weight, which results in advantages for production and assembly.

Under consideration of static requirements and assembly, it is furthermore advantageous to arrange the inner dowel strips with the lower dowel rail and the outer dowel strips with the upper dowel rail.

In an additional configuration of the embodiment according to the invention, there is a one-piece dowel strip for such a shearing reinforcement, characterized in that at least two groups of vertical dowels are attached on the dowel strip parallel and at a distance from one another. The dowels have each an elongated shank and an enlarged head at least on the end opposite the dowel rail, wherein the diameter of the shanks of the first group of dowels is larger than the diameter of shanks of at least a second group of dowels.

BRIEF DESCRIPTION OF THE DRAWINGS

The invention is explained in more detail below by embodiment examples, which are illustrated in drawings.

FIG. 2 shows an enlarged cross-sectional view taken to the left of line II—II in FIG. 1 with the ceiling reinforcement illustrated.

FIG. 3 shows a side view of a dowel strip used for the shearing reinforcement in FIG. 1 and FIG. 2.

DETAILED DESCRIPTION OF PREFERRED EMBODIMENT OF THE INVENTION

Figure 1:
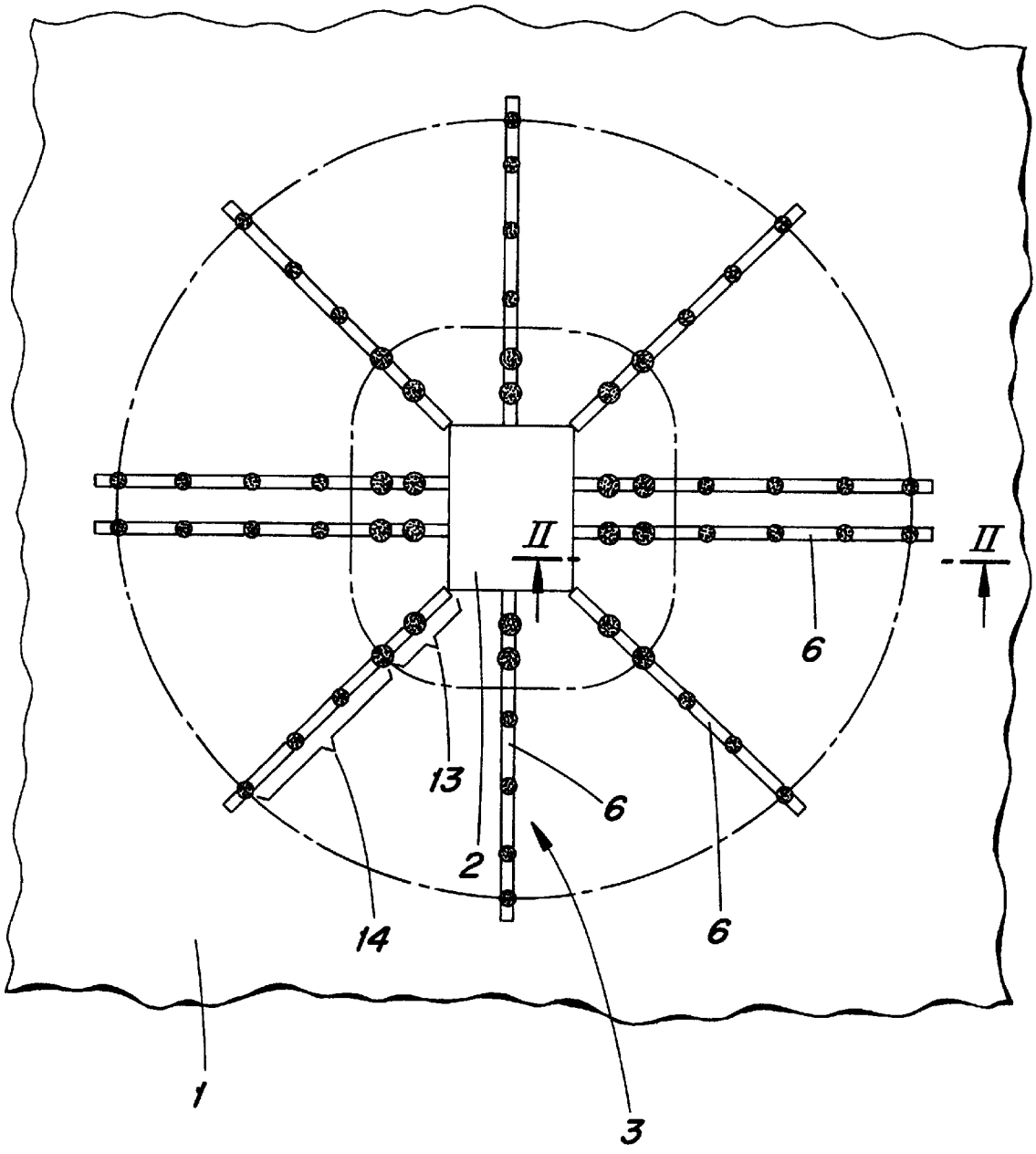
FIG. 1 shows a schematic horizontal projection of a flat ceiling in the bearing area with the shearing reinforcement arranged therein and whereby the ceiling reinforcement has been omitted for reasons of clarity.

FIG. 1 is a segment of a flat ceiling 1 made of reinforced concrete in a horizontal projection in the region of stay 2 or ceiling support. A shearing reinforcement 3 is used for transmission of forces in the flat ceiling 1 and forms thereby a pierced reinforcement of the flat ceiling 1.

As illustrated in FIG. 2, the flat ceiling 1 is provided with a ceiling reinforcement in a traditional manner, which consists of an upper reinforcement layer 4 and a lower reinforcement layer 5. The shearing reinforcement 3 is made of several dowel strips 6, which are positioned essentially radial to the axis of the stay 2. Each dowel strip 6 consists of a dowel rail or plate 7 to which several vertical dowels 8 and 8' are attached parallel and at a distance from one another.

Each dowel 8, 8' has an elongated, preferably cylindrical shank 9 or 9' and is provided at both ends with an upsetted, enlarged head 10 or 10'. As shown in FIG. 2, the dowel strips 6 are fitted into the ceiling reinforcement 4, 5 in such a manner that the dowel rails 7 are positioned on top of the upper reinforcement layer 4 and whereby the dowels 8, 8' extend downward to the lower reinforcement layer 5.

As shown in FIG. 3, two groups 11 and 12 of dowels 8 or 8' are attached to the dowel rail 7 of each dowel strip 6. In the first group 11 of dowels 8, the shanks 9 have a larger diameter than the shanks 9' of the dowels 8'.

As shown in FIG. 1 and 2, the dowel strips 6 are arranged in such a manner that dowels 8 with shanks 9 of larger diameters, belonging to the first group 11, are located in the zone 13 near the stay; whereas dowels 8' with shanks 9' of smaller diameters, belonging to the second group 12, are located in the zone 14 away from the stay. The zone 13 near the stay and the zone 14 away from the stay are essentially annular zones, which are arranged adjacent to one another and concentric around the stay 2. In the illustrated embodiment example, the outer diameter of the zone 14 away from the stay is more than twice as large as the outer diameter of the zone 13 near the stay.

Figure 4:
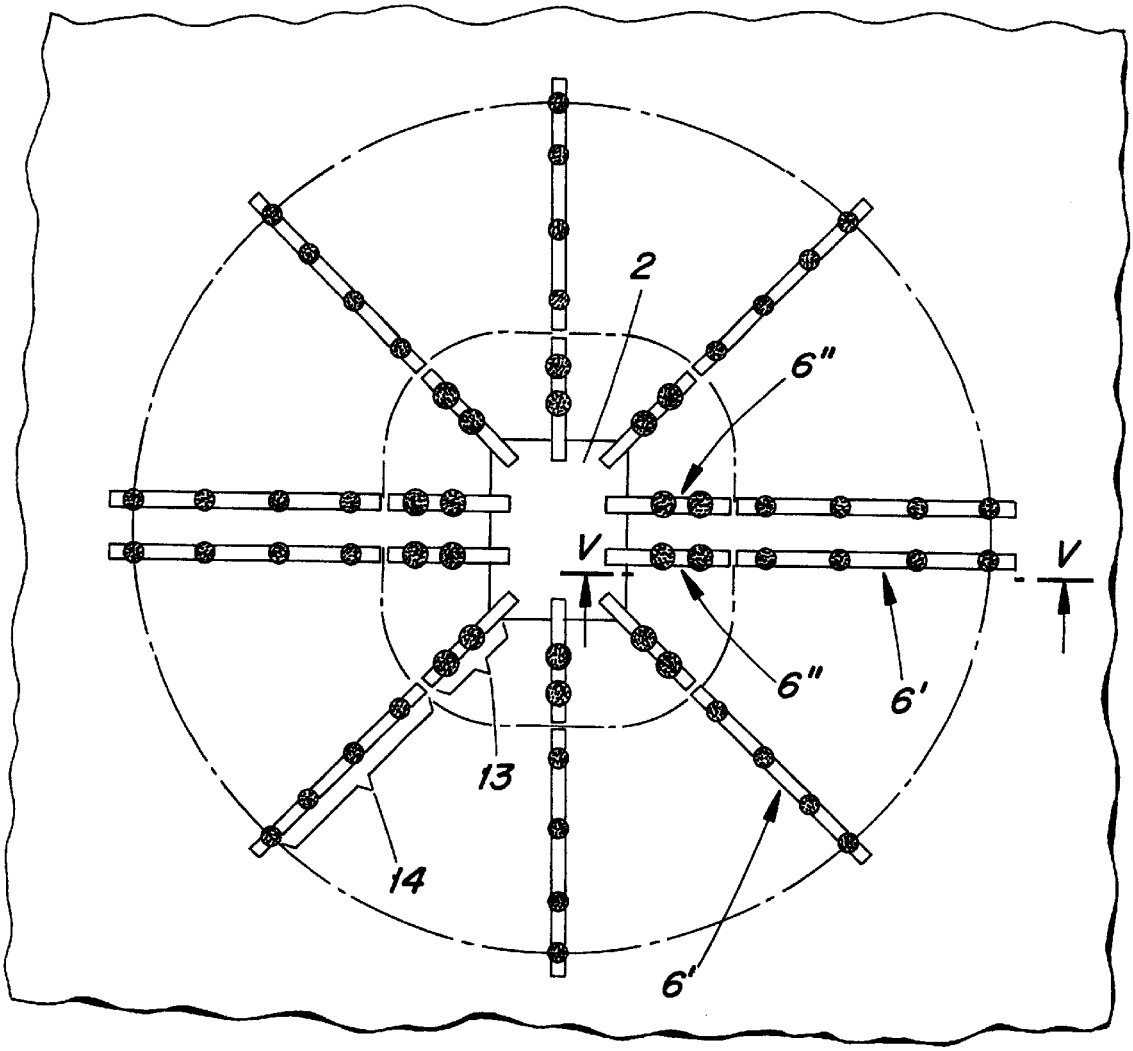
FIG. 4 shows in an illustration relative to FIG. 1 a modified embodiment with separate dowel strips for the zones near the stay and away from the stay.
Figure 5:
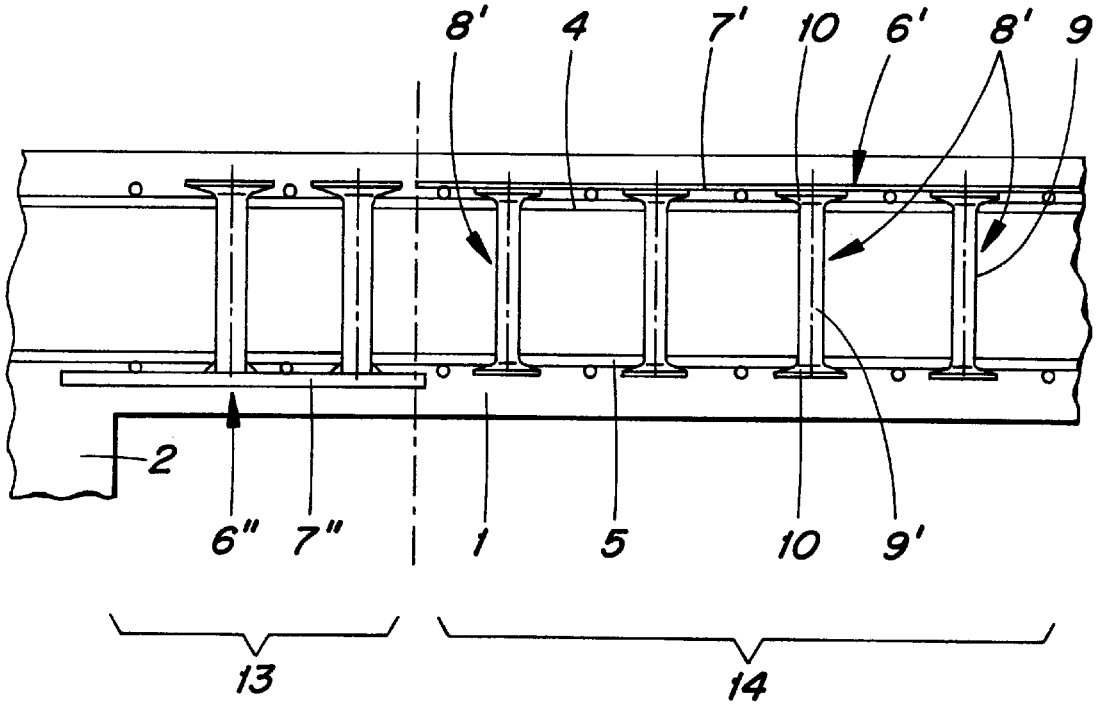
FIG. 5 shows a cross-sectional view along line V—V in FIG. 4.

The embodiment example illustrated in FIG. 4 and 5 differs from the previously described embodiment example substantially in the fact that a separate inner dowel strip 6" and an outer dowel strip 6' are located in the zone 13 near the stay and in the zone 14 away from the stay, respectively, and which strips are aligned with one another. The outer dowel strips 6' are designed in a manner previously described whereby the dowels 8' designed as double-headed dowels are fastened, for example, by rivets or screws to the upper dowel rail 7'. Said upper dowel strip is used hereby merely to secure positioning (of the dowels), whereby the dowels 8" of the inner dowel strip 6" are each welded at one end of their shanks 9" to the inner, lower rail 7". The end of the inner dowel rail 7" facing the stay extends all the way to the stay 2. The inner dowel rail 7" is used here not only to secure positioning of the dowels 8" but is used substantially also for load transmission from the surrounding concrete material onto the dowels 8".

The diameters of the shanks 9" of the dowels 8" of the inner dowel strips 6" are here also larger than the diameters of the shanks 9' of the dowels 8' of the outer dowel strip 6' in the zone 14 away from the stay, just as in the previously described embodiment example.

What is claimed is:

1. A shearing reinforcement for a flat ceiling having a support, the reinforcement comprising a plurality of dowel strips arranged in a substantially radial array with respect to the support, each dowel strip comprising a dowel rail arrangement and a plurality of vertical parallel dowels attached thereto at a distance from one another, each dowel including an elongated shank, at least one end of the shank being provided with an enlarged head, a first plurality of the dowels located near the support having larger-diameter shanks and associated heads than a second plurality of the dowels located farther from the support.

2. The shearing reinforcement according to claim 1 wherein the first plurality of dowels are disposed in a first zone surrounding the support, and the second plurality of dowels are disposed in a second zone surrounding the first zone.

3. The shearing reinforcement according to claim 2 wherein a distance from a center of the support to an end of the second zone is at least twice as large as a distance from the center of the support to an end of the first zone.

4. The shearing reinforcement according to claim 3 wherein the second zone has a substantially circular outer border.

5. The shearing reinforcement according to claim 1 wherein at least one of the dowel rail arrangements comprises a plurality of rails, one of the rails connected to the first plurality of dowels, and another of the rails connected to the second plurality of dowels.

6. The shearing reinforcement according to claim 5 wherein the rails of each rail arrangement are aligned with one another.

7. The shearing reinforcement according to claim 5 wherein each shank of the first plurality of dowels has an enlarged head on only an end thereof situated remote from the respective rail, with the other end thereof being welded to the respective rail; each shank of the second plurality of dowels has enlarged heads at both ends thereof, with one of such enlarged heads being welded to the respective rail.

8. The shearing reinforcement according to claim 7 wherein the rail connected to the first plurality of dowels is disposed beneath those dowels; the rail connected to the second plurality of dowels being disposed above those dowels.

9. A ceiling reinforcing dowel strip comprising a rail having first and second ends, a plurality of parallel vertical dowels attached to the rail in spaced apart relationship, each dowel having an elongated shank and an enlarged head on at least an end of the shank located opposite the rail, a group of the shanks and associated heads disposed near the first end of the rail having a larger diameter than another group of the shanks and associated heads disposed nearer to the second end of the rail.

10. A method of providing shearing reinforcement for a flat ceiling having a support, the method comprising the steps of:

A) arranging a plurality of dowel strips in a substantially radial array with respect to the support, each dowel strip comprising a dowel rail arrangement and a plurality of vertical parallel dowels attached thereto at a distance from one another, each dowel including an elongated shank, at least one end of the shank being provided with an enlarged head; and B) dimensioning the shanks and associated heads of the first plurality of dowels with a larger diameter than the shanks and associated heads of the second plurality of dowels.

* * * * *